US011247088B2

(12) United States Patent
Westberg

(10) Patent No.: US 11,247,088 B2
(45) Date of Patent: Feb. 15, 2022

(54) FIRE EXTINGUISHING DEVICE AND METHOD FOR EXTINGUISHING A FIRE

(71) Applicant: AM WESTBERG INVEST AB, Bromma (SE)

(72) Inventor: Andreas Westberg, Bromma (SE)

(73) Assignee: AM WESTBERG INVEST AB, Bromma (SE)

( * ) Notice: Subject to any disclaimer, the term of this patent is extended or adjusted under 35 U.S.C. 154(b) by 184 days.

(21) Appl. No.: 16/468,813

(22) PCT Filed: Dec. 13, 2017

(86) PCT No.: PCT/SE2017/051268
§ 371 (c)(1),
(2) Date: Jun. 12, 2019

(87) PCT Pub. No.: WO2018/117947
PCT Pub. Date: Jun. 28, 2018

(65) Prior Publication Data

US 2019/0329082 A1 Oct. 31, 2019

(30) Foreign Application Priority Data

Dec. 19, 2016 (SE) ..... 1651681-7

(51) Int. Cl.
*A62C 99/00* (2010.01)
*A62C 13/64* (2006.01)
(Continued)

(52) U.S. Cl.
CPC ..... *A62C 99/0027* (2013.01); *A62C 13/64* (2013.01); *A62C 13/70* (2013.01); *A62C 13/78* (2013.01)

(58) Field of Classification Search
CPC ..... A62C 99/0027; A62C 13/64; A62C 13/78; A62C 13/70
(Continued)

(56) References Cited

U.S. PATENT DOCUMENTS 2,564,733 A * 8/1951 Sipkin ..... A62C 99/0027 169/89
2,644,313 A * 7/1953 Griggs ..... A62C 99/0027 169/89
(Continued)

FOREIGN PATENT DOCUMENTS

CN 101360535 A 2/2009
CN 102410121 A 4/2012
(Continued)

OTHER PUBLICATIONS

International Search Report from corresponding International Patent Application No. PCT/SE2017/051268, dated Feb. 8, 2018, 3 pages.

*Primary Examiner* — Steven J Ganey
(74) *Attorney, Agent, or Firm* — Tucker Ellis LLP

(57) ABSTRACT

Fire extinguishing device (100). The invention is characterised in that the fire extinguishing device comprises a flask engagement means (110), arranged to engage with a flask (10) for compressed carbon dioxide and to hold the fire extinguishing device in an operating orientation in relation to such a flask; an actuating means (120), arranged to apply a pressure on a valve (13) of said flask when in said operating orientation so that the valve as a result of said pressure opens and carbon dioxide flows out from the flask, which actuating means in turn comprises a lever means (121) for transferring a force applied by a user within said actuating means (120) for applying said pressure; and a carbon dioxide directing means (130), arranged to direct a
(Continued)

jet (20) of carbon dioxide flowing out from the flask when said valve is open.

15 Claims, 12 Drawing Sheets

(51) Int. Cl.
*A62C 13/78* (2006.01)
*A62C 13/70* (2006.01)

(58) Field of Classification Search
USPC ..... 169/11, 30, 47, 71, 74, 88, 89; 239/436, 239/452, 499, 519, 533.1, 533.13, 581.1, 239/581.2, 602, DIG. 12
See application file for complete search history.

(56) References Cited

U.S. PATENT DOCUMENTS

| | | | |
|---|---|---|---|
| 2003/0094195 | A1 | 5/2003 | Huang |
| 2013/0014964 | A1 | 1/2013 | Yoshida |

FOREIGN PATENT DOCUMENTS

| | | | |
|---|---|---|---|
| EP | 0380852 | A1 | 8/1990 |
| EP | 2018895 | A1 | 1/2009 |
| WO | 0226328 | A1 | 4/2002 |
| WO | 2013043700 | A1 | 3/2013 |
| WO | 2016129788 | A1 | 8/2016 |

* cited by examiner

FIRE EXTINGUISHING DEVICE AND METHOD FOR EXTINGUISHING A FIRE

The present invention relates to a fire extinguishing device for extinguishing small-scale fires, for instance in kitchen environments. In particular, the invention relates to such a fire extinguishing device arranged to cooperate with a pressurized carbon dioxide container or flask, such as a standard size carbon dioxide flask, such as such a flask used for producing carbonized beverages in domestic homes. When in use, the fire extinguishing device cooperates with such a flask so as to direct a jet of carbon dioxide towards the fire, whereupon the fire is extinguished. The invention also relates to such a fire extinguishing method.

For extinguishing small-scale fires, fire extinguishers of different types are known. Such extinguishers generally work well in the sense that they efficiently extinguish small-scale fires, such as in kitchens. They can be based upon, for instance, dry powder or foam extinguishing, where contents from a flask are emptied onto the fire so as to extinguish the fire by removing oxygen necessary to maintain the oxidizing reaction. Conventionally, the flask is typically an integrated part of the extinguisher.

There are several problems with such conventional extinguishers. Hence, when the flask has been emptied it must be refilled before the extinguisher can be used again. Also, the extinguisher must be checked with respect to proper functionality at regular intervals, for instance that the pressure is sufficient in the flask. Furthermore, such extinguishers are quite bulky, in order to contain sufficient amounts of the extinguishing medium for extinguishing the fire completely. They are typically also brightly coloured, for being clearly visible when needed. All in all, these properties maximize the chances that a fire extinguisher will be easy to find and work as intended once a fire is detected.

However, these properties also increase the chances that an extinguisher which is owned by a user is not available for use when needed. The user may have missed refilling or properly checking the extinguisher. Also, extinguishers, being bulky and brightly colored, are often not perceived as attractive as interior decoration objects, and are in practice, therefore, frequently hidden away out of sight. In practice, then, an extinguisher which is only very rarely used may be difficult to find on the very short notice, such as within seconds, necessary once a fire has been detected.

Also, after using conventional fire extinguishers, the premises must in general be sanitized, which is expensive.

The present invention solves the above described problems, in particular by realizing that a source of fire extinguishing medium is already readily available in many kitchens, in the form of pressurized carbon dioxide flasks for producing carbonized beverages. For instance, such flasks are used in SodaStream® home appliance carbonizing solutions. Furthermore, it has been realized that the fire extinguishing capability provided by the carbon dioxide contents of such a flask, while it may not readily compare to purpose-built fire extinguishers, it is generally adequate to extinguish smaller fires, or for delaying fire development sufficiently to save lives. Importantly, such flasks are readily available in many kitchens, and since they are typically frequently used and replaced, users have a high chance of finding them once needed.

Carbon dioxide does not soil the premises where the fire is extinguished as much as conventional fire extinguishers.

Furthermore, the present invention proposes a number of preferred ways of exploiting such flasks for fire extinguishing purposes. As such, the fire extinguishing device according to the invention can easily be made less bulky and aesthetically more attractive than conventional fire extinguishers, making it more attractive to store it where it can readily be seen by the user in need to, under time pressure, extinguish a discovered small-scale fire.

Hence, the invention relates to a fire extinguishing device, which device is characterised in that the fire extinguishing device comprises a flask engagement means, arranged to engage with a flask for compressed carbon dioxide and to hold the fire extinguishing device in an operating orientation in relation to such a flask, which flask is associated with a longitudinal direction extending in a upwards direction from a flask bottom to a flask top and a downwards direction from said top to said bottom, a radial direction perpendicular to said longitudinal direction, and an angular direction; an actuating means, arranged to apply a pressure on a valve of said flask when in said operating orientation so that the valve as a result of said pressure opens and carbon dioxide flows out from the flask, which actuating means in turn comprises a linearly or rotary acting lever means for transferring a force applied by a user within said actuating means for applying said pressure; and a carbon dioxide directing means, arranged to direct a jet of carbon dioxide flowing out from the flask when said valve is open.

The invention also relates to a method for extinguishing a fire, which method is characterised in that the method comprises providing a fire extinguishing device comprising a flask engagement means, arranged to engage with a flask for compressed carbon dioxide and to hold the fire extinguishing device in an operating orientation in relation to such a flask, which flask is associated with a longitudinal direction extending in a upwards direction from a bottom to a top and a downwards direction from said top to said bottom, a radial direction perpendicular to said longitudinal direction, and an angular direction; an actuating means, arranged to apply a pressure on a valve of said flask when in said operating orientation so that the valve as a result of said pressure opens and carbon dioxide flows out from the flask; a linearly or rotary acting lever means for transferring a force applied by a user within said actuating means for applying said pressure; and a carbon dioxide directing means, arranged to direct a jet of carbon dioxide flowing out from the flask when said valve is open; in that the method comprises further providing a flask of the said type, and in that the method also comprises the user directing the said carbon dioxide directing means towards a base of the fire and applying said force onto said actuating means.

In the following, the invention will be described in detail, with reference to exemplifying embodiments of the invention and to the enclosed drawings, wherein.

Figure 13B:
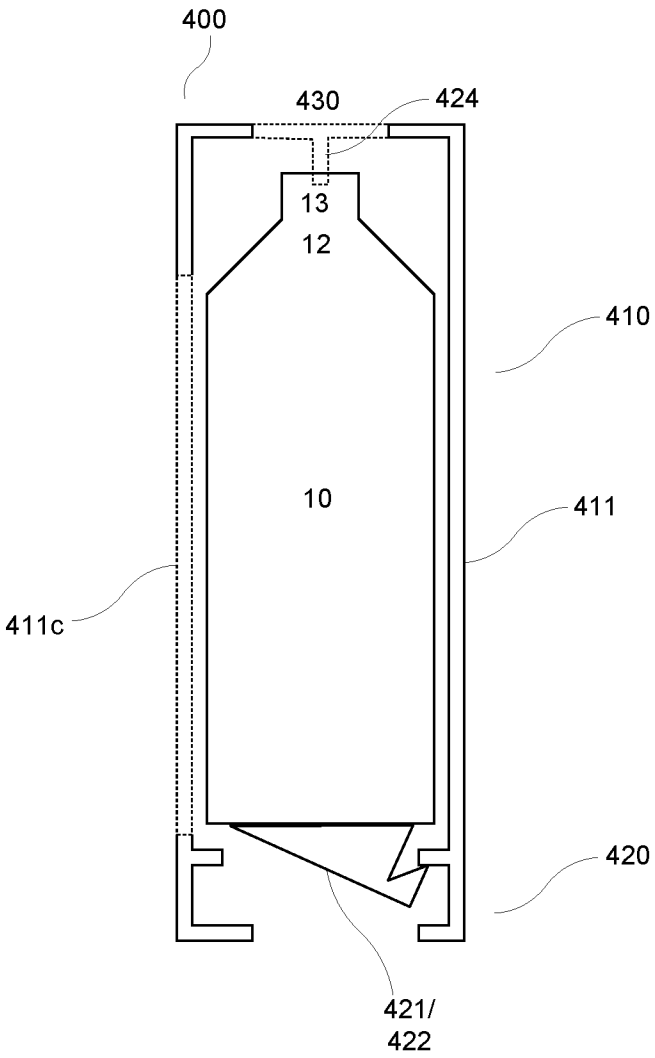
Figure 13A:
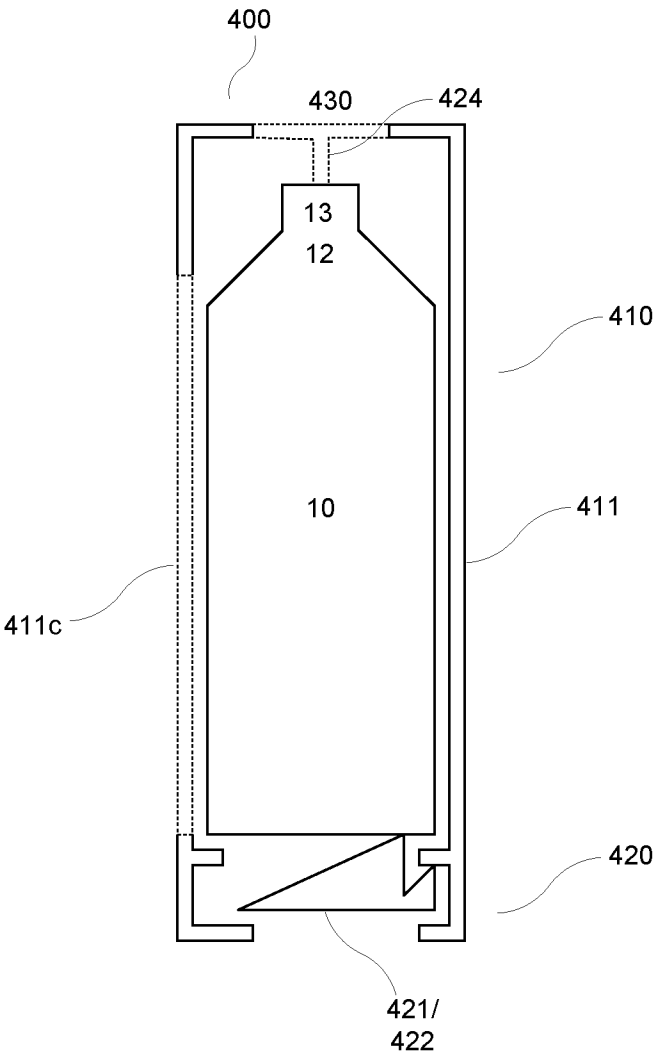
Figure 14B:
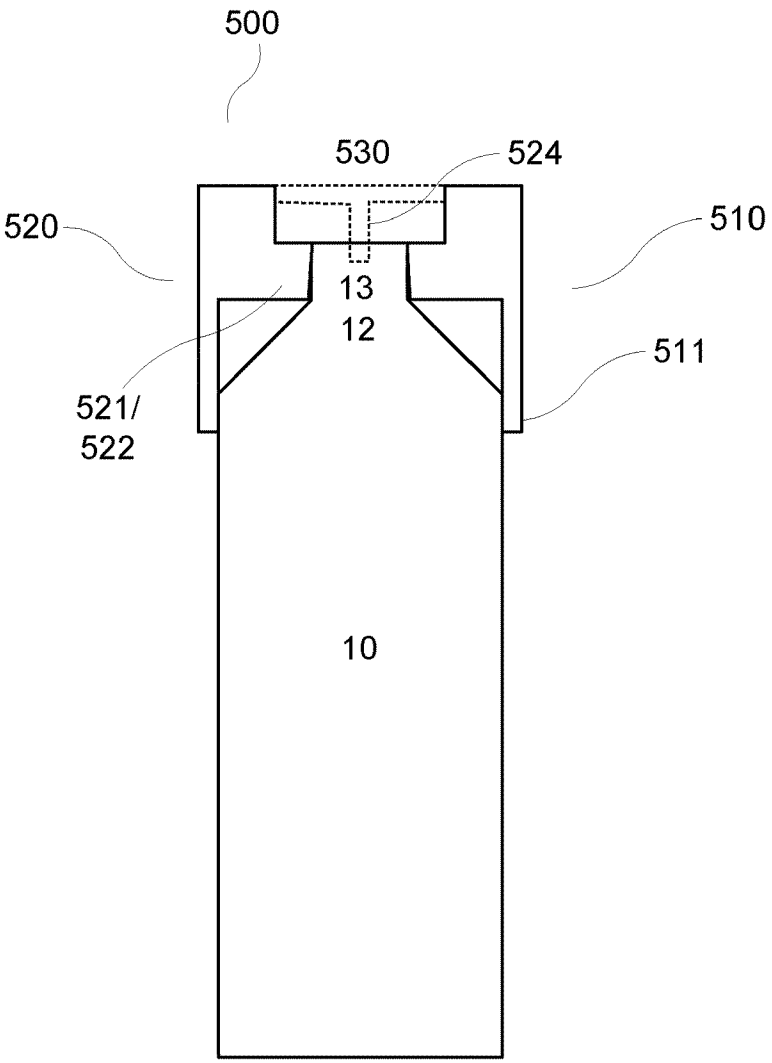
Figure 14A:
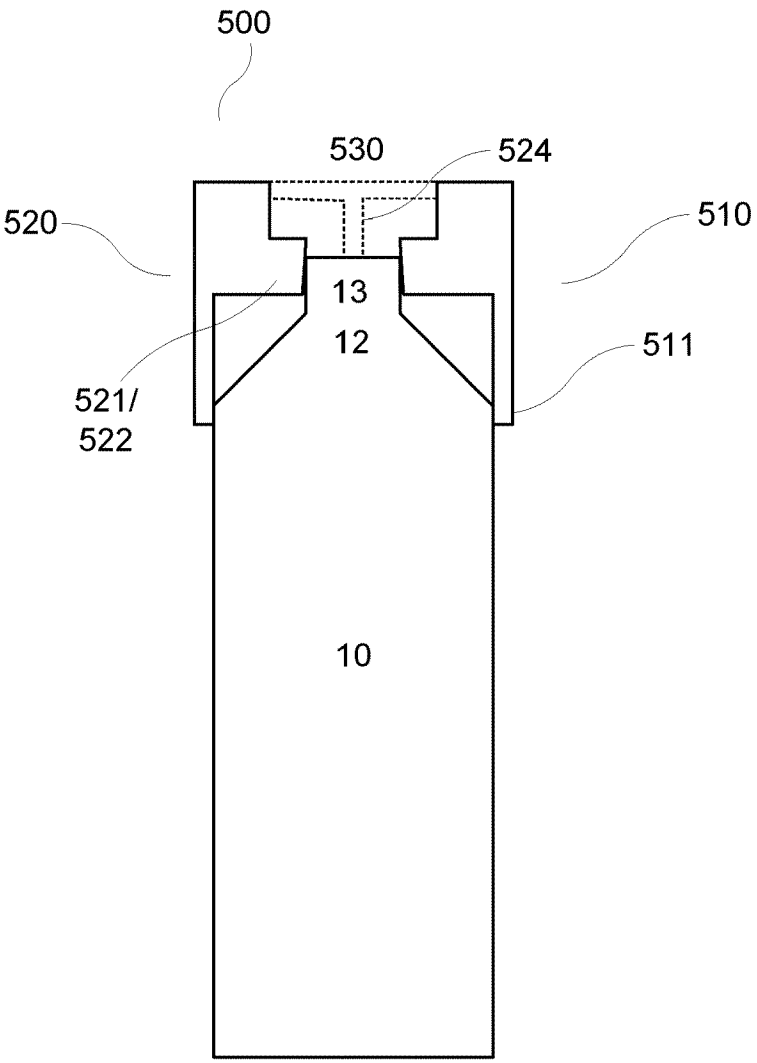

FIGS. 13*a* and 13*b* are simplified side section views of a fire extinguishing device according to a fourth exemplifying embodiment of the invention in a first and a second state; and FIGS. 14*a* and 14*b* are simplified side section views of a fire extinguishing device according to a fifth exemplifying embodiment of the invention in a first and a second state.

All figures share the same reference numerals for same or corresponding parts. FIGS. 1-11, 13*a*-14*b* are simplified views, that are in general not to scale and with certain conventional and/or irrelevant details not shown for increased clarity.

Hence, the present invention relates to a fire extinguishing device 100, 200, 300, 400, 500 as illustrated in FIGS. 1-11.

In general, the fire extinguishing device 100, 200, 300, 400, 500 according to the invention is arranged to be used together with a flask 10 for compressed carbon dioxide. It is preferred that the flask 10 is a standard flask for compressed carbon dioxide of the type which is used as a carbon dioxide source when producing carbonated beverages in domestic homes. Examples of appliances for making such carbonated beverages, using and being compatible with such flasks, comprise SodaStream®. There are currently a very large number, such as several millions, such flasks 10 distributed in domestic homes throughout the world. Typically, the carbon dioxide contents of such a flask 10 is sufficient for producing about 50 liters of carbonated beverage, and must thereafter be replenished or replaced by a filled flask 10. Hence, such flasks 10 are in fact relatively common in domestic homes, and are frequently used and handled in such homes. Such flasks 10 are generally of the same standard size, within certain limits, and are, for compatibility reasons, equipped with a standard valve with standardized threads for installation in appliances of the above type. Such flasks 10 are typically cylindrical, about 40 cm, or more precisely about 37 cm, of length and with a diameter of about 5-7 cm, more particularly about 6 cm, in particular about 6.2 cm. The gas pressure of a full such flask 10 is typically between about 50 and about 250 bars and contains about 0.4-0.5 kg of $CO_2$ in liquid phase.

Figure 1:
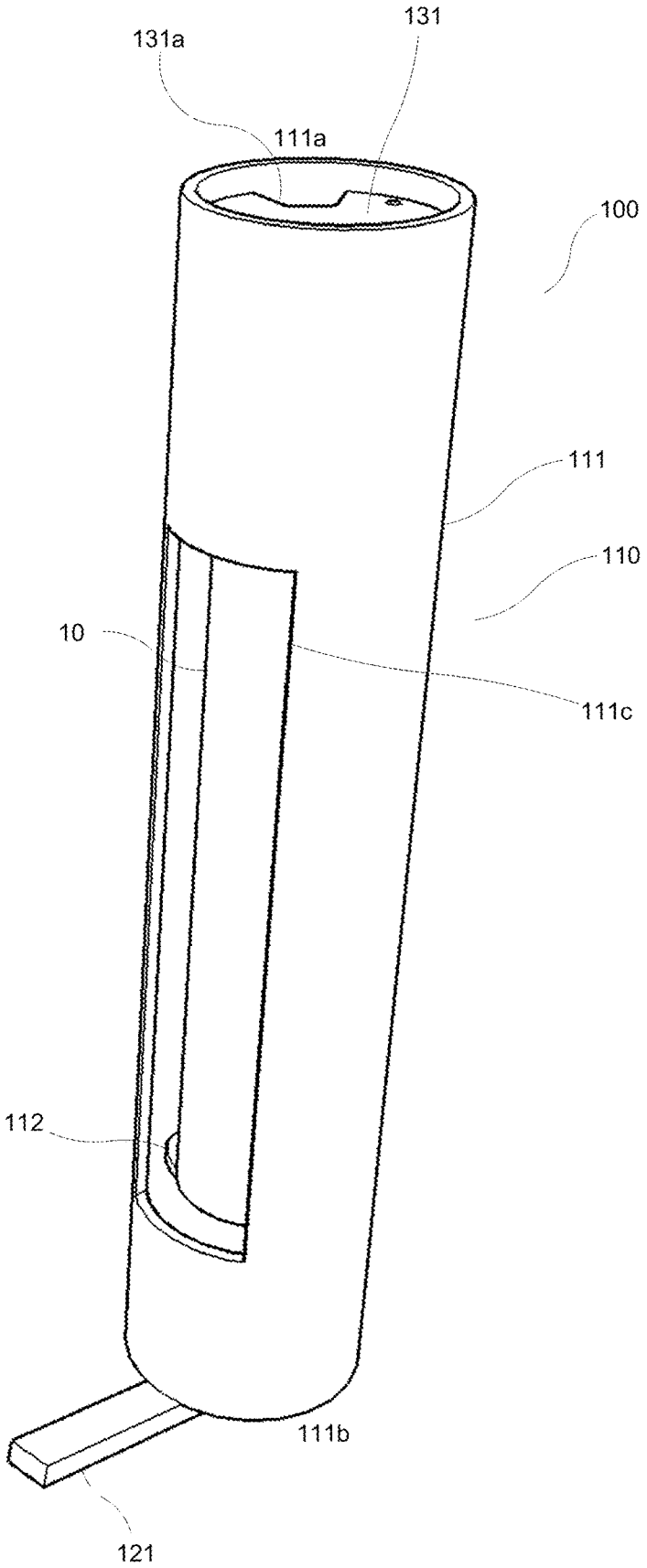
FIG. 1 is an overview image of a fire extinguishing device according to a first exemplifying embodiment of the invention.
Figure 2:
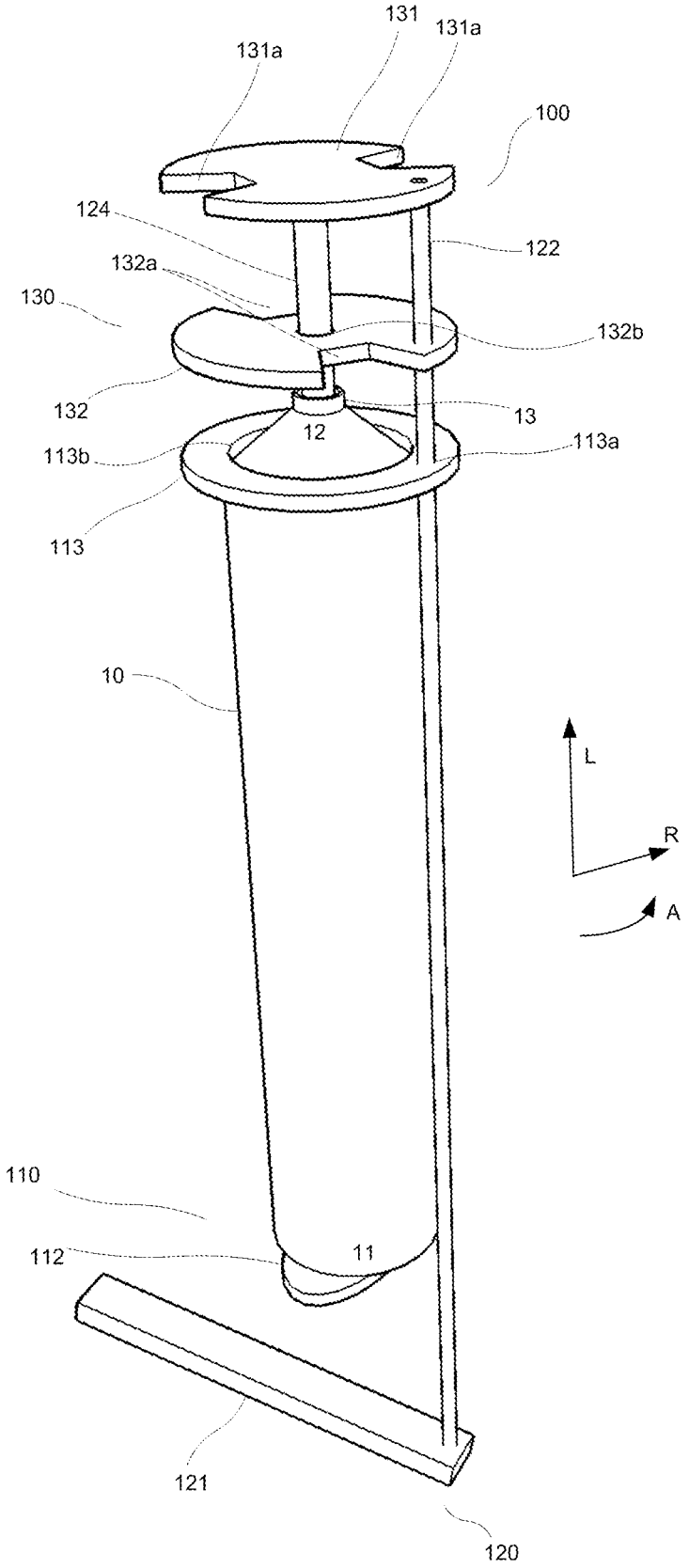
FIG. 2 is a partly removed view of the fire extinguishing device shown in FIG. 1.

As illustrated in FIG. 2, such a flask 10 is associated with a main longitudinal direction L, in an upwards longitudinal direction directed from a flask 10 bottom 11 to a flask 10 top 12 and in a downwards longitudinal direction directed from the top 12 to the bottom 11. The flask 10 is furthermore associated with an angular A and a radial R direction, the latter of which is perpendicular to the longitudinal direction L and can be directed outwards or inwards in relation to the flask 10 radial centre.

Turning now first specifically to FIGS. 1-6, according to the invention the fire extinguishing device 100 comprises a flask 10 engagement means 110, arranged to engage with a flask 10 of the above described type, and to hold the fire extinguishing device in an operating orientation in relation to such a flask 10. The operating orientation is illustrated in FIGS. 1-6, and for the second and third exemplifying embodiment shown in FIGS. 7-10. In the operating orientation, the flask 10 engagement means 110, 210, 310, 410, 510 fully engages with the flask 10, for instance in the sense that the flask 10 has been inserted into the engagement means 110 (FIGS. 1-6) or that the flask engagement means 210, 310 has been screwed onto the flask 10 valve 13 threads (FIGS. 7-10), so that the fire extinguishing device 100, 200, 300, 400, 500 as a result of this full engagement has a well-defined relative orientation in space in relation to the flask 10 with which it engages and so that when the below-described actuation means 120, 220, 320, 420, 520 is activated by a user, the flask 10 valve 13 is opened so as to allow carbon dioxide to escape out from the flask 10 and to be directed as intended by the below-described carbon dioxide directing means 130, 230, 330, 430, 530.

Hence, according to the invention the fire extinguishing device 100 further comprises an actuating means 120, arranged to apply a pressure on a valve 13 actuator of said flask 10 when in said operating orientation, so that the valve 13 as a result of said applied pressure opens and carbon dioxide flows out from the flask 10. The details regarding the valve mechanism and carbon dioxide outflow in the direct vicinity of the valve 13 is conventional as such, and is not described in any detail herein.

The actuating means 120 further comprises a linearly or rotary acting lever means 121, 122 for transferring a force applied by a user, within said actuating means 120, and for thereby applying said pressure.

That the lever means acts "linearly" means that the lever means may work by translating a substantially linear motion of longer total length into a corresponding linear motion of shorter total length of the valve 13 actuator of the flask 10, so that a force required to be applied by the user is smaller than a corresponding force required to achieve said pressure on the valve 13 should such a corresponding force be applied directly to the valve.

That the lever means acts "rotary" means that the lever means may work by translating a substantially rotary motion of the lever means, whereby a point on the lever means at which the user applies said force travels a certain distance in this rotary motion, into a corresponding linear motion of the valve 13 actuator of the flask 10, which linear motion is shorter than the certain distance. As a result, again a force required to be applied by the user so as to move the said point in such a rotary motion is smaller than a corresponding force required to achieve said pressure on the valve 13 should such a corresponding force be applied directly to the valve.

In general, it is preferred that a linearly acting lever means is used, for safety reasons. However, FIGS. 14*a* and 14*b* illustrates an example of a rotary acting lever means.

Moreover, the fire extinguishing device 100 according to the present invention also comprises a carbon dioxide directing means 130, arranged to direct a jet 20 (see FIG. 11) of carbon dioxide flowing out from the flask 10 when said valve 13 is open. It is preferred that the said jet 20 is directed in, or substantially in, the upward longitudinal direction L, but the carbon dioxide directing means 130 could also be arranged so that the jet 20 is directed in the radial direction R, or somewhere in between these two extremes.

Such a fire extinguishing device offers a number of advantages. It can be made very simple and small, as explained hereinbelow. It can also be made aesthetically attractive, encouraging users not to keep it out of sight. It can be designed to be simple and fail-safe to use for extinguishing small-scale fires. Moreover, the present inventors have discovered that the carbon dioxide provided by a flask 10 of the above type is often sufficient for putting out small-scale fires, such as a typical fire in a kitchen. As an example, the present invention can be successfully used to put out, or at least delay, an oil-containing frying pan or pot catching fire due to high cooking temperatures.

According to a preferred embodiment, illustrated in FIGS. 1-6, the flask 10 engagement means 110 comprises a tubular member 111, arranged to limit the movement of the flask 10 in relation to the fire extinguishing device 100 in the radial direction R of the flask 10 when the fire extinguishing device 100 is in said operating orientation. As illustrated in FIGS. 1-6, the tubular member 111 may comprise an upper opening 111*a*, a lower opening 111*b* and/or an access hole 111*c*. The access hole 111*c* is for inserting and removing the flask 10 from the flask 10 engagement means 110, such as when the flask 10 engagement means 110 comprises a bottom shoulder means, or stopper, 112 of the below-described type.

Preferably, the tubular member 111 is arranged to, in said operating orientation, extend along at least the whole longitudinal L length of the flask 10.

According to a preferred embodiment as shown in FIGS. 1-6, the flask 10 engagement means 110 of the fire extinguishing device 100 further comprises a top shoulder means 113, arranged to limit the movement of the flask 10 in its upwards longitudinal direction L when the fire extinguishing device 100 is in said operating orientation. The top shoulder means 113 is preferably arranged with a seal, in turn arranged to prevent carbon dioxide to flow inside the tubular member 111 along the flask 10 in its downwards longitudinal direction L, past the top shoulder means 113, when the fire extinguishing device 100 is in the operating orientation. As seen in FIGS. 1-6, the top shoulder means 113 comprises a through hole 113*b*, through which the top 12 of the flask 10 is arranged to be partly introduced, so that a through hole 113*b* edge seals against the flask 10 external surface. Hence, the through hole 113*b* has a smaller diameter than a maximum external flask 10 diameter. In the embodiment illustrated in FIGS. 1-6, the top shoulder means 113 contacts the flask 10 when the flask 13 is properly inserted into the flask engagement means 110, by being supported by the below-described bottom shoulder means 112. However, according to a non-illustrated preferred embodiment, the top shoulder means 113 is automatically pressed down against the flask 10 surface as a result of the user applying the said force, for instance via a separate lever system or using the lever system 121, 122.

Hence, the fire extinguishing device 100 preferably comprises a bottom shoulder means 112, arranged to limit the movement of the flask 10 in its longitudinal downwards direction L when the fire extinguishing device 100 is in said operating orientation. The top 113 and bottom 112 shoulder means are preferably distanced one from the other so as to hold the flask 10 using a certain longitudinal pressure. For instance, the top 113 and/or bottom 112 shoulder means may be spring-loaded so as to press the flask 10 towards the opposite respective shoulder means in the operating orientation. This provides both a safe hold and a reliable seal of the flask 10. Such a seal is important, since the carbon dioxide flowing out from the flask 10 is typically very cold, and if the user is put into direct contact therewith, the user runs the risk of dropping the fire extinguishing device 100 during use in reaction to the cold. In worst case, the user may even be injured by the cold, if exposed to prolonged flows of the rapidly expanded carbon dioxide.

According to the preferred embodiment illustrated in FIGS. 1-6, the flask 10 engagement means 110 is not arranged to be screwed onto the flask 10, but rather only to receive the flask 10 as explained above, without the flask 10 or the fire extinguishing device 100 having to be rotated in the angular direction A in order to reach the operating orientation of the fire extinguishing device 100. This provides for reliable, fast and fail-safe mounting, into the operating orientation, of the flask 10 and the flask 10 engagement means 110 for use.

However, as illustrated in FIGS. 7-10, according to an alternative preferred embodiment, the engagement means 210, 310 comprises a screw engagement means, arranged to be screwed onto the (internal or external, as the case may be) threads of the flask 10, whereby the fire extinguishing device 200, 300 assumes the operating orientation. This also provides a fail-safe mounting, and in addition thereto makes it possible to design the fire extinguishing device 200, 300 with a largest dimension, in particular a dimension in the longitudinal direction L when in the operating orientation, which is smaller than, preferably less than half of, the longitudinal direction L length of the flask 10. This, in turn, will allow a design which is sufficiently small, allowing the fire extinguishing device to be stored visibly by a user.

In a preferred embodiment illustrated in FIGS. 1-6, the actuating means 120 comprises a pin 124, a downwards facing pin end 124*b* of which is arranged to be pressed against the said valve 13 in the downwards longitudinal direction L so as to open the valve 13. Moreover in this case, the actuating means 120 also comprises a pin holding part 131 and a pin directing or guiding part 132. The pin directing part 132 is arranged to limit the movement of the said pin 124 end 124*a* in the radial direction R when the fire extinguishing device 100 is in said operating orientation, and the pin holding part 131 is arranged at a longitudinal-direction L distance from said pin directing part 132. This arrangement in general achieves safe and fail-proof operation of the device 100, since the pin directing part 132 can easily be designed so as to make impossible misalignment between the pin 124 and the valve 13.

Also, slightly varying flask 10 lengths can be accommodated for this way. The pin 124 holding part 131 attachment point, or, more preferably, the pin 124 itself may be slightly flexible, so as to be able to flex somewhat during activation by the user applying said force.

It is noted that, in the embodiment illustrated in FIGS. 1-6, the bottom shoulder means 112 acts as a counter-force provider to the pin 124 when the latter is pushed down on the valve 13.

Preferably, the pin holding part 131 comprises a first disk 131 (the pin holding part being the first disk in the exemplifying embodiment illustrated in FIGS. 1-6, even if this needs not be the case), and the pin directing part 132 comprises a second disk 132 (the pin directing part being the second disk in the exemplifying embodiment illustrated in FIGS. 1-6, even if this needs not be the case). Moreover, the first disk 131 and the second disk 133 are disposed at a distance from each other in said longitudinal direction L, as illustrated in FIGS. 1-6. In a first alternative, the second disk 133 is fixedly disposed in relation to the tubular member 111, and immobile in the longitudinal direction L in relation thereto. In a second alternative, the second disk 133 is movable in the longitudinal direction L in relation to the tubular member 111. In the said second alternative, the two disks 131, 132 are preferably disposed at a fixed distance from each other in the longitudinal direction L, and always move in parallel to each other as jointly actuated by the force transfer means 122. Preferably, a hole 132*b*, such as a through hole, in the second disk 132 is arranged to limit the said radial R movement of the pin 124 end 124*b*. Such an arrangement, with at least two longitudinally spaced disks 131, 132, has proven to achieve a very robust and fail-safe device 100 which is still simple and inexpensive to manufacture.

In particular, it is preferred that the first 131 and second 132 disks are arranged to, when the fire extinguishing device 100 is in said operating orientation, seal the said tubular part 111, via contact between a respective outer periphery edge of the respective disk 131, 132 and an inner surface of said tubular member 111, so as to prevent carbon dioxide to flow in the upwards longitudinal direction L from the valve 13, except for through respective openings 131*a*, 132*a* in said first 131 and second 132 disks, respectively. Hence, using such an arrangement of the disks 131, 132, the carbon dioxide released through the valve 13 is forced to flow out into the surrounding atmosphere through the openings 131*a*, 132*a*, why a very controlled flow of carbon dioxide can be achieved. Preferably, the openings 131*a*, 132*a* mutually arranged so as to achieve a turbulent carbon dioxide flow through the top-most opening 131*a* and out through the carbon dioxide directing means 130 into the surrounding atmosphere when the valve 13 is fully open, in particular given the specific internal geometry of the carbon dioxide directing means 130 and the expected pressure of a fully loaded flask 10. Using such a controlled, turbulent flow, a jet 20 of carbon dioxide which is very efficient for putting out small-scale fires is achieved. Also, the risk for clogging by dry ice is decreased.

In particular, it is preferred that the openings 131*a*, 132*a* are not aligned in the angular direction A of the flask 10 when the fire extinguishing device 100 is in the operating orientation, but offset in the angular direction 10. As illustrated in FIGS. 1-6, the openings 131*a*, 132*a* are arranged with a displacement of about 45° one in relation to the next as seen in the longitudinal direction, which is preferred, at least it is preferred to have an angular displacement of 30-60° between such subsequent disks 131, 132.

In particular, it is preferred that the openings 131*a*, 132*a* of subsequent disks 131, 132 have substantially no angular overlap.

In FIGS. 1-6, the preferred embodiment is shown in which the openings 131*a*, 132*a* are not through holes in the disks 131, 132, but are arranged in the form of radial indentations in the disks 131, 132. Preferably, each disk 131, 132 is arranged with at least two openings 131*a*, 132*a*, that are preferably arranged equidistantly in the angular direction A. Preferably, the respective openings 131*a*, 132*a* of each disk 131, 132 cover at the most 25% of the disk 131, 132 surface. Preferably, the respective openings 131*a*, 132*a* of each disk 131, 132 cover at least 10% of the disk 131, 132 surface. Each of these considerations has proved to achieve a more efficient jet 20 of carbon dioxide.

It is understood that there may be more than two discs 131, 132, even if the arrangement with two discs 131, 132 arranged both to hold and steer the pin 124 and providing a turbulent flow is simple and efficient, and therefore preferred.

Figure 3:
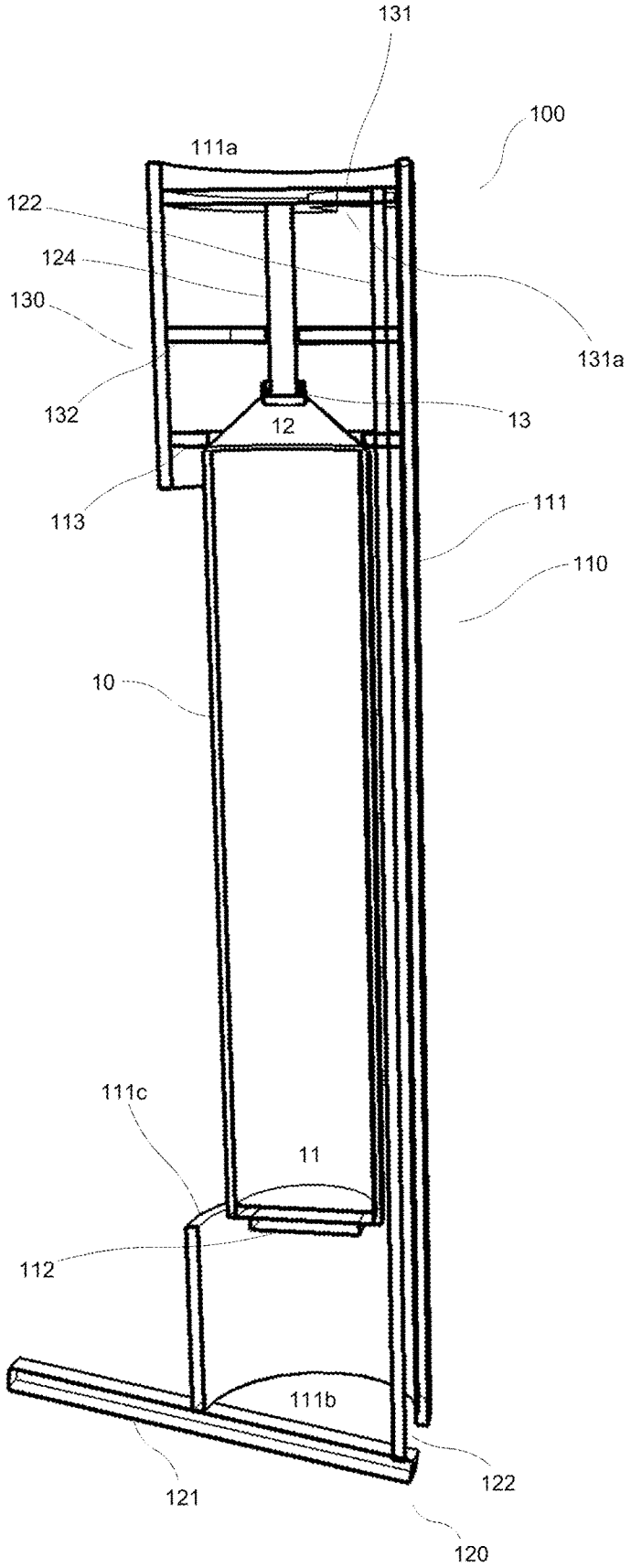
FIGS. 3 and 4 are respective section views of the fire extinguishing device shown in FIG. 1 in a first and second state.
Figure 4:
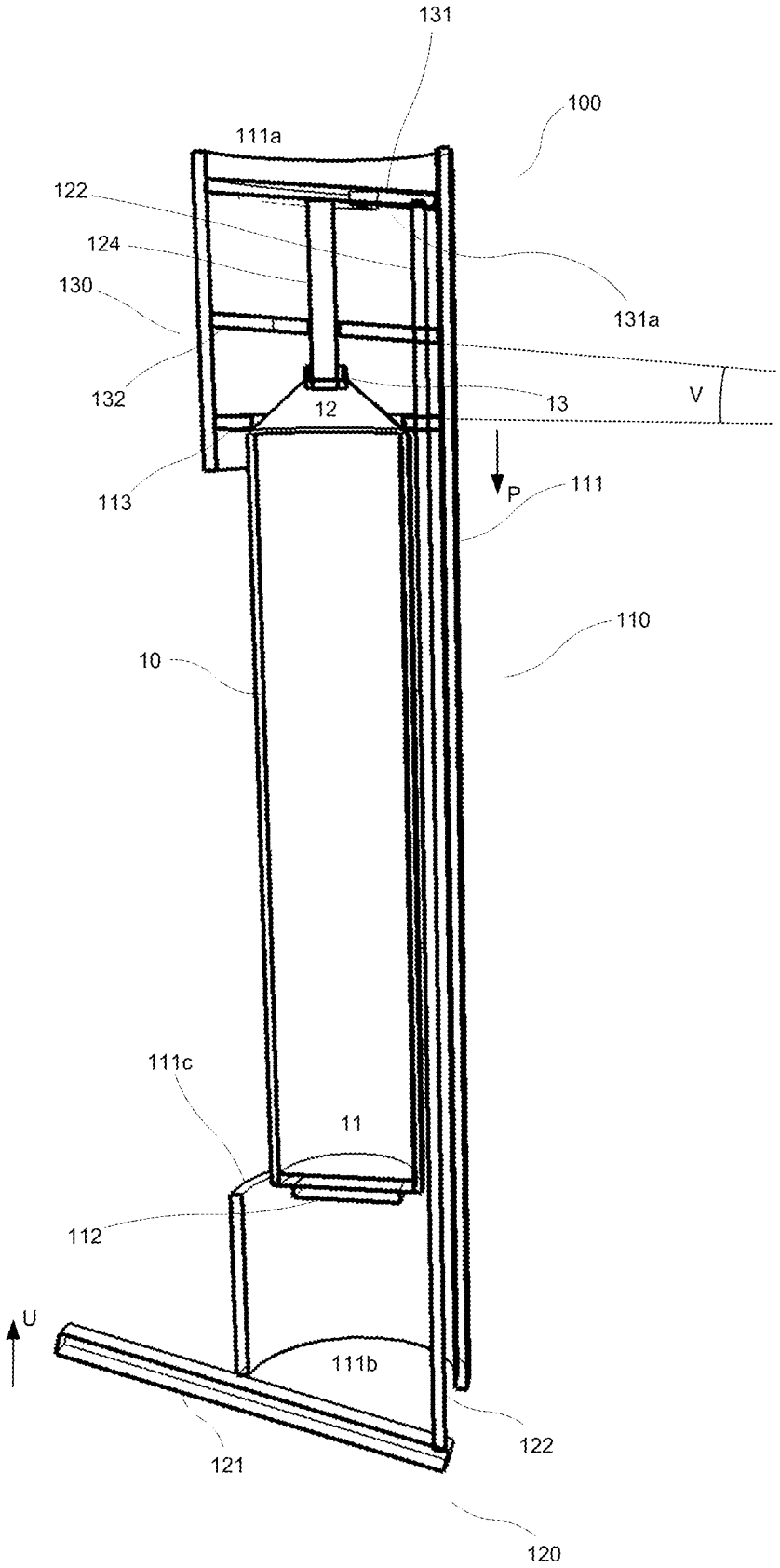
Figure 5:
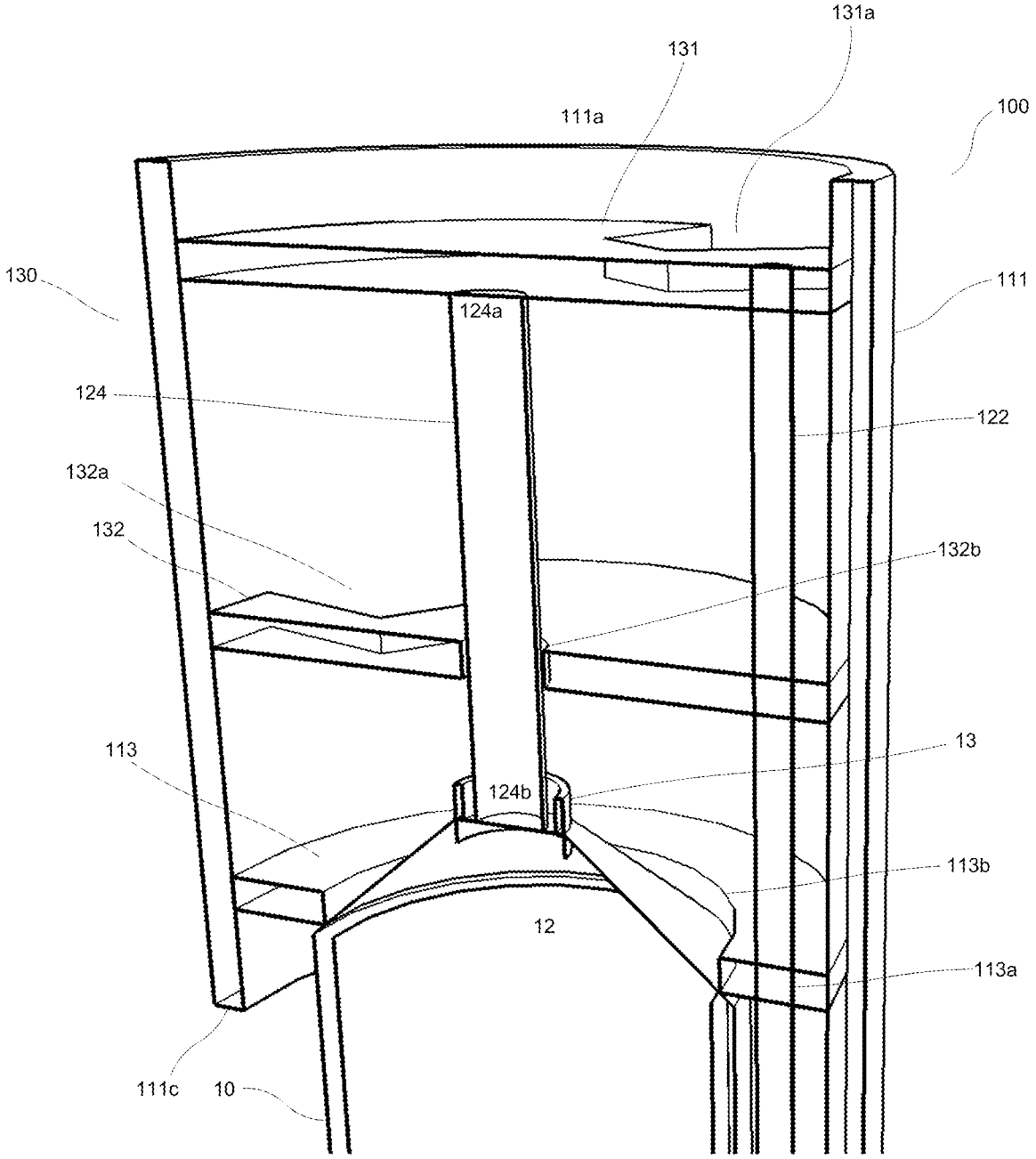
FIGS. 5 and 6 are respective detail section views of the fire extinguishing device shown in FIG. 1 in said first and second states.
Figure 6:
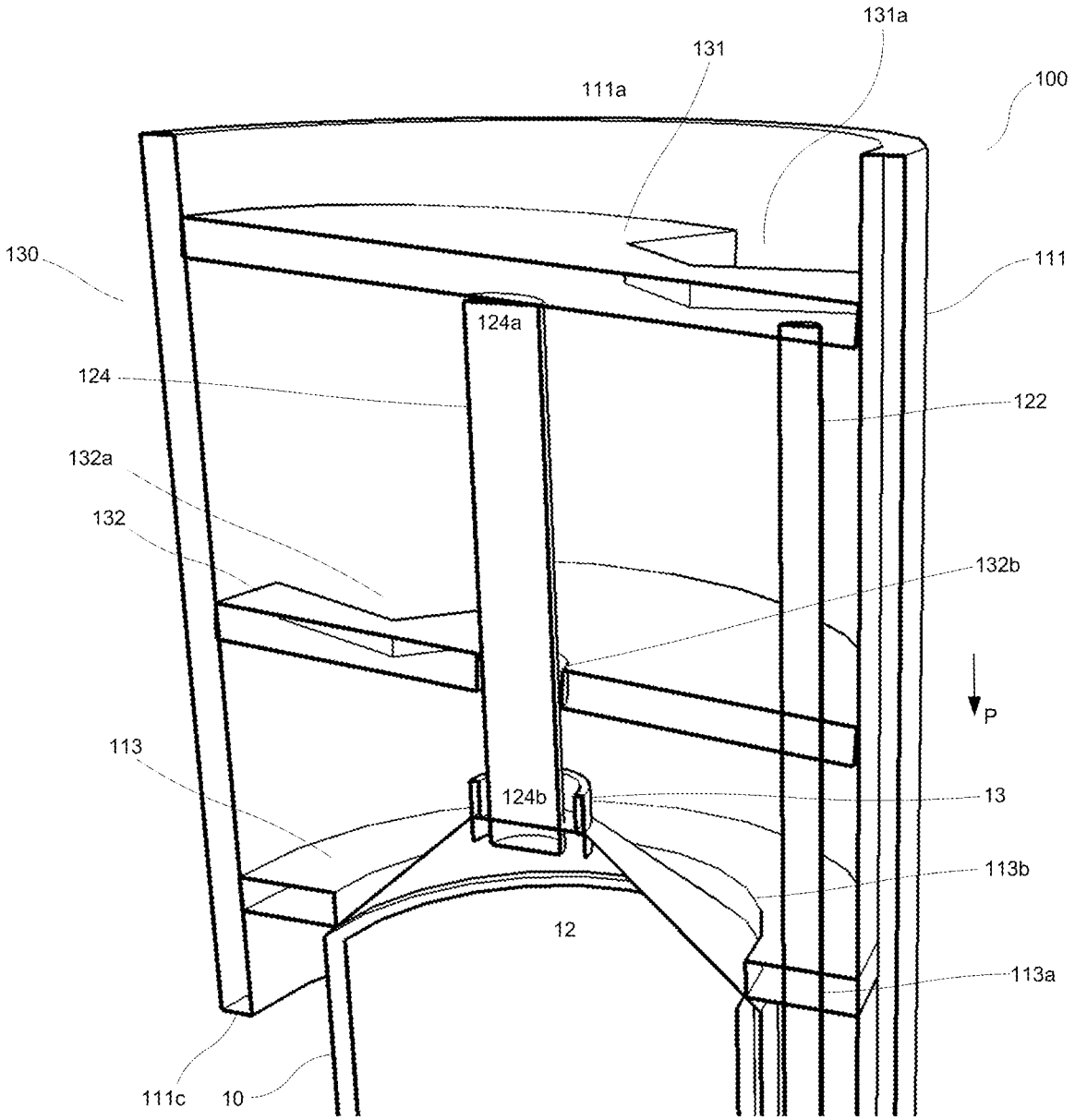

Hence, according to a preferred embodiment, illustrated in FIGS. 1-6, the actuating means 120 is arranged to displace the first, upper-most, disc 131, and as a result also the pin 124, in the downwards longitudinal direction L when the user applies said force. This is illustrated in FIGS. 3-6, in which FIGS. 3 and 5 illustrate the state of the fire extinguishing device 100 when in rest, while FIGS. 4 and 6 illustrate the state when the user applies said force and the pin 124 is consequently pressed down onto the valve 13, which latter is opened as a result.

Hence, the actuating means 120 comprises a lever 121 and a force transfer means 122 in the form of a metal bar, a flexible rope or similar. The user pushes the lever 121, effectively pulling the transfer means 122 in the downwards longitudinal direction L. The force transfer means 122 is attached to the first disk 131. The first disk 131 is hingedly or pivotably attached, such as to the tubular member 111, at a side of the first disk 131 which is arranged to the opposite, in a main plane of the disk 131 in question, of the attachment point to the force transfer means 122, why the force transfer means 122 forces the first disk 131 to pivot in the downwards longitudinal direction L, as illustrated in FIGS. 4 and 6. As a result, the pin 124, which is attached with a top end 124*a* to the first disk 131, is pressed downwards. Furthermore, as discussed above in the said second alternative, the second disk 132 is preferably also attached to the force transfer means 122, and is hence forced to pivot downwards in a substantially parallel way as compared to the first disk 131 by the pull by the force transfer means 122. The second disk 132 may be hingedly or pivotably attached in a way corresponding to the attachment of the first disk 131 so as to allow said pivoting. It is realized that both disks 131, 132 may also be rigidly attached but somewhat flexible, so that the force transfer means 122 forces the disks 131, 132 to bend in the downwards longitudinal direction L in a substantially parallel manner.

As the disks 131, 132 are preferably displaced in parallel in the said second alternative, the pin 124 directing part 132 will be able to keep the pin 124 substantially parallel to the longitudinal direction L at all times during the downwards movement of the pin 124, which provides a simple yet fail-safe construction.

The force transfer means 122 may preferably run freely through a hole 113*a* in the top shoulder means 113, which hole 113*a* is preferably a through hole arranged to provide a sealing engagement with the force transfer means 122.

The pin 124 is preferably aligned with, and overlapping, a central flask 10 longitudinal axis.

For all embodiments illustrated in FIGS. 1-8, the cylindrical member 111, 211 is preferably circular cylindrical. The disks 131, 132 are preferably also circular cylindrical, apart from the openings 131*a*, 132*a* and geometry in connection to the said attachment points.

The pivoting or bending angle V, downwards, of the disks 131, 132 is preferably between 2-5°, see FIG. 4.

Hence, in operation the user applies a force, in a general direction U, to the lever 121, which is transferred to the pin 124 and on to the valve 13. The corresponding is true in the embodiment shown in FIGS. 7-8, in which a lever 121 is used to, via a force-transferring device 222, apply a corresponding downwards-direction P pressure to the valve 13; and in the embodiment shown in FIGS. 9-10, in which a lever 321 is arranged to transfer such a force to apply a downwards-direction P pressure to the valve 13.

Since the valve 13 is typically spring-loaded towards a closed state, or is closed by means of the internal pressure of the flask 10 if not actively pressed, the lever 121, 221, 321 is preferably not spring-loaded apart from the counter-force provided by the valve 13 itself.

Irrespectively of the type of lever 121, 221, 321, it is, for similar reasons as described above in relation to the seal, preferred that the lever means 121, 221, 321 is arranged to transfer, via the actuating means 120, a force, applied by the user to a location on the fire extinguishing device 100, 200, 300 arranged at least 25 cm from the valve 13, when the fire extinguishing device 100, 200, 300 is in said operating position. Preferably, the downwards component of a straight path between the point of application of said force and the valve 13 is at least 10 cm.

Also preferably, the lever means 121, 221, 321 is arranged, when the fire extinguishing device 100, 200, 300 is in said operating orientation, to allow the user to apply said force either in the radial direction R, towards a central longitudinal axis of the flask 10 (as illustrated in FIGS. 7-10), or in the upwards longitudinal direction L (as illustrated in FIGS. 1-6).

Figure 9:
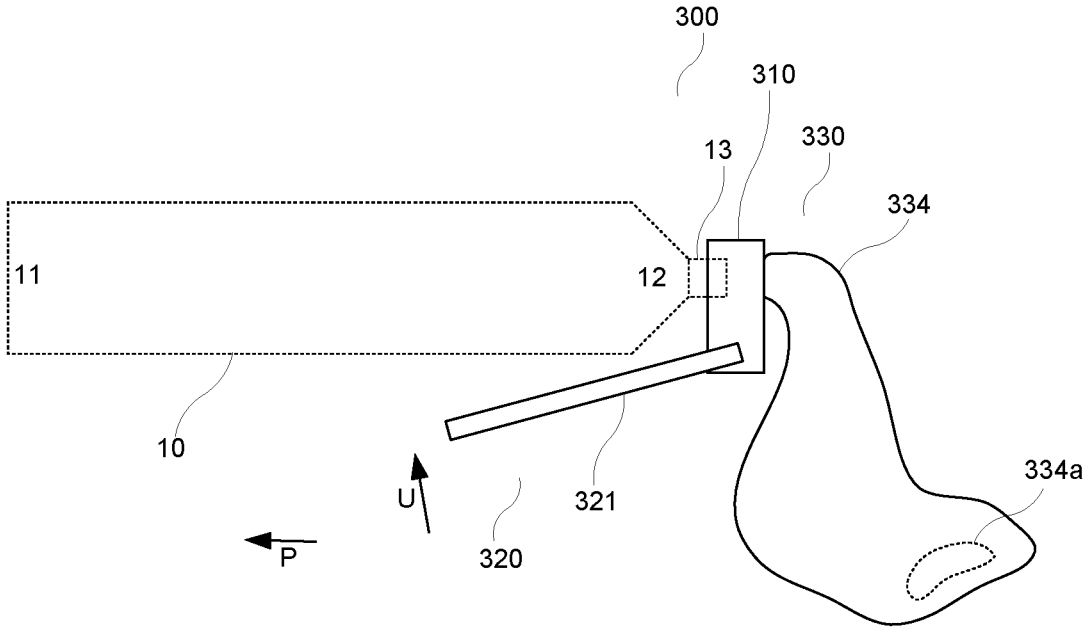
FIGS. 9 and 10 are respective section views of a fire extinguishing device according to a third exemplifying embodiment of the invention in a first and second state.
Figure 10:
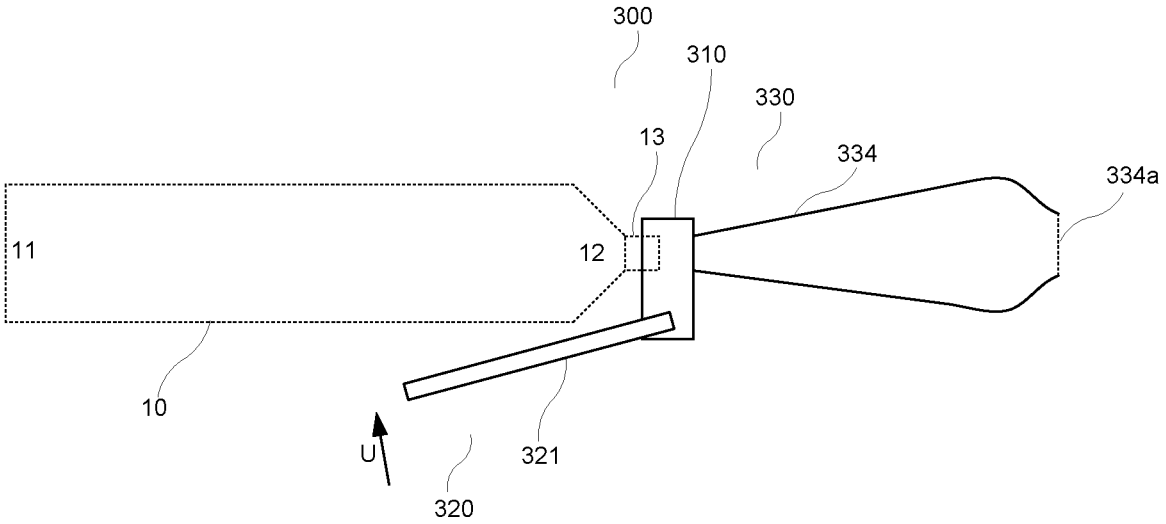

FIGS. 9 and 10 illustrate an alternative, or supplementary, carbon dioxide directing means 330, in the form of a generally tubular, flexible nozzle 332 having an opening 334*a* in an end which is distal in relation to the flask 10 when the fire extinguishing device 300 is in the operating orientation. FIG. 9 shows the rest state of the operating orientation fire extinguishing device 300, while FIG. 10 shows its state when the user applies said force so as to, via actuation means 320, open the valve 13 so that the carbon dioxide flows out from the flask 10. When the device 300 is activated this way, the nozzle 334 is arranged to be expanded by the carbon dioxide being provided to the interior of the nozzle 334, so as to assume an inflated shape forming the said jet 20, flowing out from the opening 334*a*. Such a construction, with or (preferably) without an upstream double-disk arrangement 131, 132 as explained above in relation to FIGS. 1-6, has proven to be very light-weight yet reliable with a possibility to direct the carbon dioxide precisely without the user having to neither be too close to the cold carbon dioxide jet 20 nor too close to the fire 1 to be extinguished. Also, since the nozzle 334 is flexible, the fire extinguishing device 300 can be made foldable, in order to provide attractive storability. Preferably, the nozzle 334 is tapered towards the opening 334*a*, so that it is wider some distance from the opening 334 in a direction towards the flask 10. The flexible nozzle 334*a* is preferably made of fire-proof textile material; or a resilient sheet material such as rubber or latex.

Figure 7:
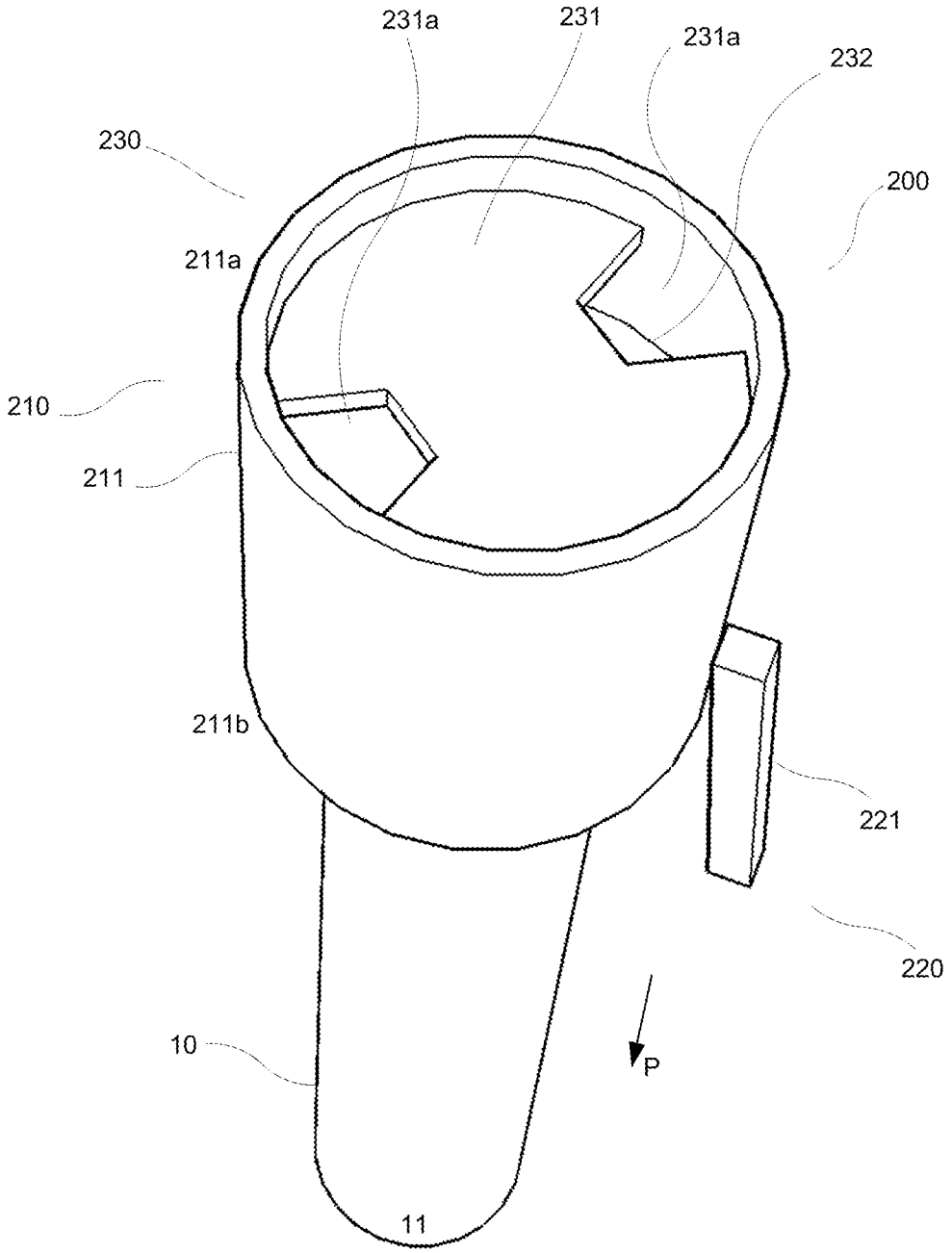
FIG. 7 is an overview image of a fire extinguishing device according to a second exemplifying embodiment of the invention.
Figure 8:
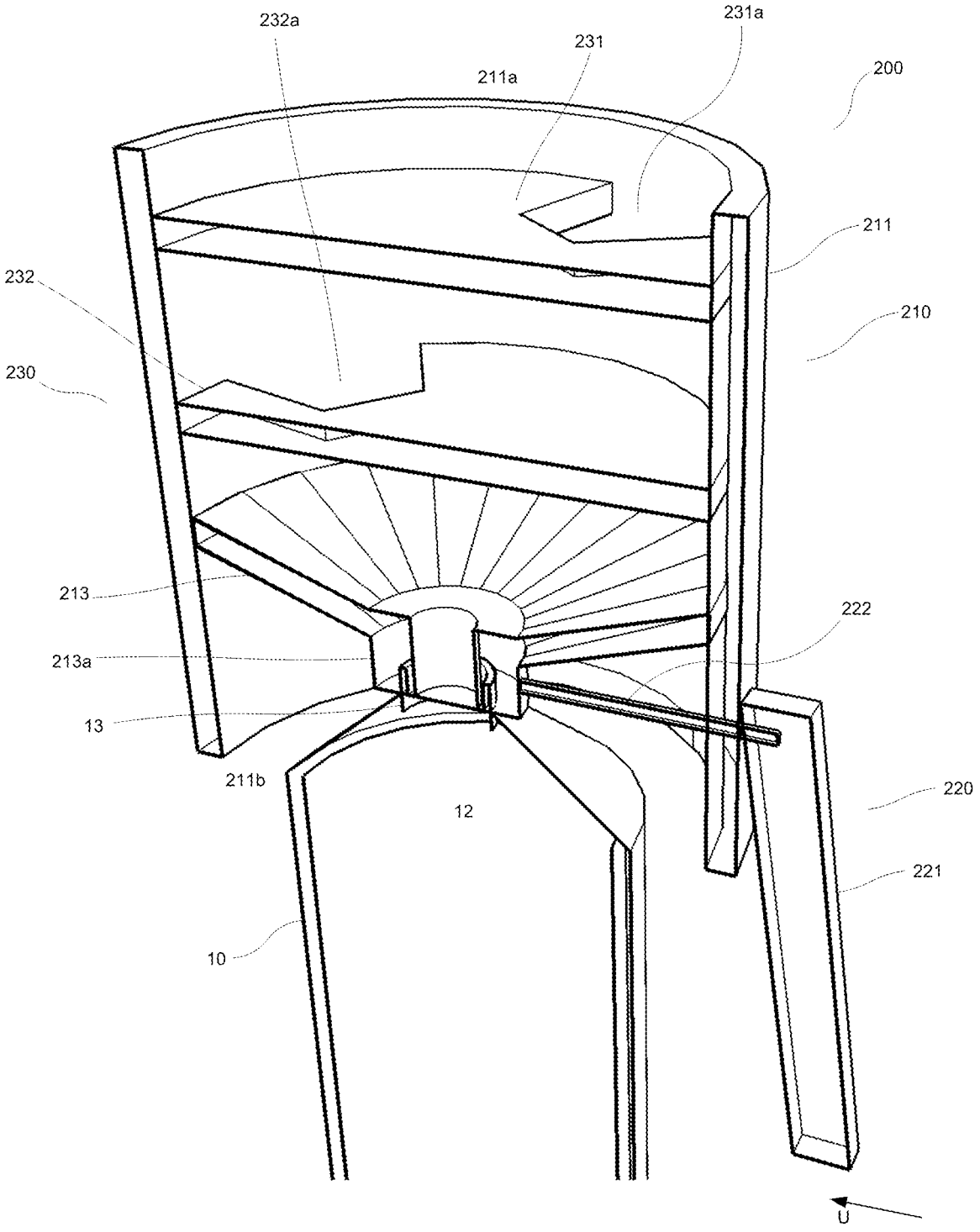
FIG. 8 is a detail section view of the fire extinguishing device shown in FIG. 7.

As seen in FIGS. 7-8, the fire extinguishing device 200 also comprises a tubular means 211, corresponding to tubular means 111 and having an upper 211*a* and a lower 211*b* end. Moreover, the fire extinguishing device 200 also comprises first 231 and second 232 disks, with openings 231*a*, 232*a*, functioning in the corresponding manner as disks 131, 132 with openings 131*a*, 132*a* described above. However, the fire extinguishing device 200 does not comprise parts corresponding to shoulders 112, 113. Rather, a separate sealing part 213, which does not have a shoulder function, is arranged with a fastening means 213*a* arranged with threads for engaging with corresponding threads on the valve 13 when mounting the fire extinguishing device 200 onto the flask 10 so as to achieve said operating orientation. The sealing part 213 seals off the carbon dioxide flowing out from the valve 13 from travelling in the downwards longitudinal direction L, past the sealing part 213, reaching the hands of the user.

If the fire extinguisher 200, 300 is screwed onto the flask 10 in order to achieve the operating orientation, it is preferred that the carbon dioxide is not transferred from the valve 13 to or within a carbon dioxide directing means 230, 330 using a flexible or non-flexible tube or duct, since such a tube or duct provides an undesired pressure fall. In case such a tube or duct is used, for instance to provide directability of the jet 20, it is preferably no more than 20 cm, preferably no more than 10 cm, of length.

Preferably, the cylindrical member 211 has a diameter which is approximately, or at the most, identical to the radius of the flask. Further preferably, the cylindrical member 211 rests on the tapered upper part of the flask 10, which then will form a sturdy construction when the fire extinguisher 200 is fully engaged with the flask 10 in the operating orientation. In other words, the cylindrical member 211 will form an approximately continuous cylindrical body of constant diameter together with the flask 10. Alternatively, the inner diameter of the cylindrical member 211 corresponds to the outer diameter of the flask 10, so that the cylindrical member 211 forms an abutting sleeve along an upper end part of the flask 10 when fully engaged in said operating orientation. A sleeve of this type is illustrated in FIGS. 14*a* and 14*b*.

Figure 11:
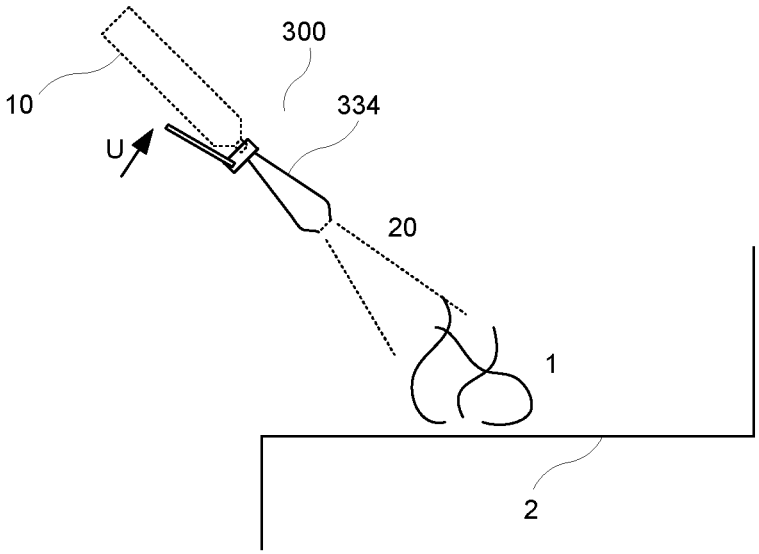
FIG. 11 is an image showing the use of a fire extinguishing device according to the invention for putting out a small-scale fire.

FIG. 11 illustrates a typical use situation of the present invention, in which a fire extinguishing device according to the above, in this particular example having a nozzle 334 of the type illustrated in FIGS. 9-10, is in the operating orientation with respect to a pressurized carbon dioxide flask 10 of the above described type, and where a user has applied a force in the direction U so that the flask 10 valve 13 has been opened and a carbon dioxide jet 20 is hence directed towards a small-scale fire 1, such as on a kitchen top 2.

Figure 12:
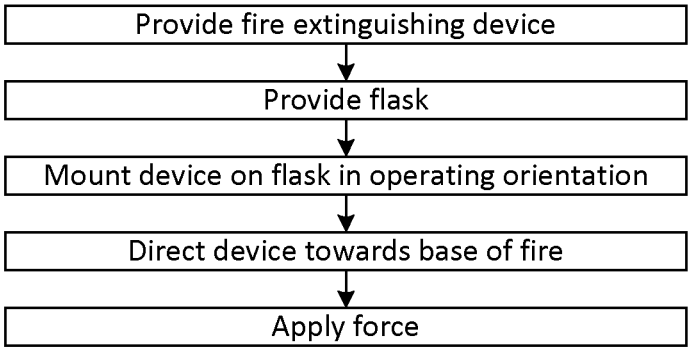
FIG. 12 is a flowchart illustrating a method according to the present invention.

FIG. 12 is a flow chart illustrating a method according to the invention for extinguishing a small-scale fire.

In a first step, a fire extinguishing device 100, 200, 300 of the above described type is provided.

In a second step, a pressurized carbon dioxide-containing flask 10 of the above described type is further provided.

The first and second steps can be performed in any order, or simultaneously.

In a third step, the fire extinguishing device 100, 200, 300 is mounted on the flask 10 in any one of the above-described ways, so as to achieve the said predetermined operating orientation of the fire extinguishing device 100, 200, 300 in relation to the flask 10.

In a fourth step, the user directs the fire extinguishing device 100, 200, 300 so that its upwards longitudinal direction L, or any other direction of the device 100, 200, 300 in which the jet 20 is arranged to be directed, is directed towards the base of the fire 1.

In a fifth step, the user applies a force, in the general direction U, onto the above-described actuating means, as a result of which and via the actuating means 120, 220, 320 the flask 10 valve 13 is opened and the carbon dioxide is released onto the said fire 1 base.

FIGS. 13*a* and 13*b* illustrate another example of a fire extinguishing device 400 according to the invention, comprising a flask 10 engagement means 410, in turn comprising a generally cylindrical tubular member 411 with an access hole 411*c* for inserting the flask 10 so as to reach the operating orientation. The device 400 further comprises an actuating means 420, comprising a lever means 421/422 acting directly on the flask 10 bottom by moving a free end of the lever means 421 towards the flask 10 bottom, in the upwards longitudinal L direction. By the lever action provided by the wedge-shaped lever means 421, the flask 10 is displaced a smaller distance upwards than the movement of the free end of the lever means 421, why a user imparting a certain upwards directed force onto the said free end manages to press the flask 10 upwards with a greater force, in turn making it possible to press the flask 10 towards a pin 424 with sufficient pressure so as to open the valve 13 and release the carbon dioxide. FIG. 13*a* shows the state before a pressure is applied; FIG. 13*b* the state when a pressure is applied and the gas can flow out. In this embodiment, the flask 10 needs not be screwed onto the device 400 before use.

A fire extinguishing device 400 of the type illustrated in FIGS. 13*a* and 13*b*, arranged to allow the user to press the flask 10 upwards, may also use one, two or more disks of the general type illustrated as 131, 132 in FIGS. 1-6. Preferably, only one such disk is used in the embodiment shown in FIGS. 13*a* and 13*b*, which disk then comprises turbulence-creating through holes.

FIGS. 14*a* and 14*b* illustrate an example using a rotary acting lever means 521/522. More particularly, the fire distinguishing device 500 according to the invention comprises a flask 10 engagement means 510, in turn comprising a generally cylindrical tubular member 511 into which the flask 10 is inserted and fastened by engaging the valve 13 threads with corresponding threads in the lever means 521/522. For instance, the lever means 521/522 may comprise interior threads arranged to be screwed onto the external threads of the valve 13. Hence, the device 500 comprises an actuator means 520 in turn comprising said lever means 521/522, that work in a rotary manner, translating a rotary motion imparted by a user to the flask 10 in relation to the device 500 by screwing the flask 10 deeper into screw engagement with the lever means 521/522. As the engagement deepens, the flask 10 travels upwards a distance with is shorter than a corresponding distance travelled by a point on the envelope surface of the tubular member 511 onto which the user imparts said force. Therefore, the rotary force imparted by the user is translated to a stronger force pressing the flask 10 towards the pin 524, until the state illustrated in FIG. 14*b* is reached, in which the carbon dioxide is release due to the valve 13 being opened. This way, the user can control the outflow amount and/or velocity of the carbon dioxide during operation by screwing or unscrewing the flask 10. The operating orientation may be reached by screwing the flask 10 only somewhat onto the lever means 521/522, sufficiently to reach engagement but insufficiently for opening the valve 13.

Above, preferred embodiments have been described. However, it is apparent to the skilled person that many modifications can be made to the disclosed embodiments without departing from the basic idea of the invention.

It is realized that the five different embodiments discussed above are merely for exemplifying purposes, and that many modifications can be made as long as the principles described herein are used.

For instance, the fire extinguishing device 100, 200, 300, 400, 500 may be provided with a hook for hanging the device 100, 200, 300, 400, 500 on the wall, or any number of aesthetically appealing design elements in order to make it a more attractive interior decorating object.

As another example, the tubular member 111 and the disks 131, 132 may be rectangular-cylindrical.

The different embodiments described herein are freely combinable as applicable. For instance, the lever 121 can be arranged to accept an inwards radial force by the user; and the directing means 130 and 230 may be provided with a nozzle 334.

Furthermore, all that has been said above regarding the fire extinguishing devices 100, 200, 300, 400, 500 is applicable to the present method, and vice versa.

Hence, the invention is not limited to the described embodiments, but can be varied within the scope of the enclosed claims.

The invention claimed is:

1. A fire extinguishing device, comprising:

a housing that screws onto a valve opening of a flask that stores compressed carbon dioxide, the flask having a valve that is secured in the valve opening and the valve being spring-loaded towards a closed state, the flask having a longitudinal direction extending in a upwards direction from a bottom of the flask to a top of the flask and a downwards direction from said top to said bottom, a radial direction perpendicular to said longitudinal direction, and an angular direction, and wherein the housing holds the fire extinguishing device in an operating orientation relative to the flask;

an actuator configured to open the valve of the flask in response to force exerted on a lever component of the actuator by a person, opening of the valve resulting in release of the carbon dioxide from the flask via the valve; and a flow director retained by the housing and configured to direct a jet of the released carbon dioxide; and wherein the fire extinguishing device, and attached flask, is configured for the person to hold the fire extinguishing device, and attached flask, and direct the jet of the released carbon dioxide toward a base of a fire.

2. The fire extinguishing device according to claim 1, wherein the housing comprises a tubular member that limits movement of the flask in relation to the fire extinguishing device in the radial direction of the flask when the fire extinguishing device is in said operating orientation.

3. The fire extinguishing device according to claim 2, wherein the fire extinguishing device further comprises a top shoulder configured, to limit the movement of the flask in its upwards direction when the fire extinguishing device is in said operating orientation, and the top shoulder has a seal configured, to prevent carbon dioxide to flow inside the tubular member along the flask in its downwards direction, past the top shoulder.

4. The fire extinguishing device according to claim 1, wherein the housing comprises a bottom shoulder configured to limit the movement of the flask in its downwards direction when the fire extinguishing device is in said operating orientation.

5. The fire extinguishing device according to claim 1, wherein the actuator comprises a pin, a pin end of which is configured to press against the valve in the downwards direction so as to open the valve, and wherein the actuator also comprises a pin holding part and a pin directing part, the pin directing part limits the movement of the pin end in the radial direction when the fire extinguishing device is in said operating orientation, and the pin holding part is spaced at a longitudinal-direction distance from said pin directing part.

6. The fire extinguishing device according to claim 5, wherein the pin holding part comprises a first disk, wherein the pin directing part comprises a second disk, wherein the first disk and the second disk are disposed at the distance from each other in said longitudinal direction, wherein a hole in the second disk limits the radial movement of the pin end.

7. The fire extinguishing device according to claim 6, wherein the housing comprises a tubular member configured to limit movement of the flask in relation to the fire extinguishing device in the radial direction of the flask when the fire extinguishing device is in said operating orientation; and the first and second disks, when the fire extinguishing device is in said operating orientation, seal the tubular part to prevent carbon dioxide to flow in the upwards direction from the valve, except for respective openings in said first and second disks, through which the carbon dioxide flows in a turbulent manner when the valve is fully open.

8. The fire extinguishing device according to claim 7, wherein the openings are not aligned in the angular direction of the flask when the fire extinguishing device is in the operating orientation.

9. The fire extinguishing device according to claim 8, wherein the openings have substantially no angular overlap.

10. The fire extinguishing device according to claim 6, wherein the actuator displaces the first disc and the pin, in the downwards direction, when the person exerts said force.

11. The fire extinguishing device according to claim 1, wherein the actuator transfer the force exerted by the person on the lever to a location on the fire extinguishing device at least 25 cm from the lever.

12. The fire extinguishing device according to claim 1, wherein the lever component is configured so that, when the fire extinguishing device is in said operating orientation, the force is applied by the person either in the radial direction towards a central axis of the flask, or in the upwards direction.

13. The fire extinguishing device according to claim 1, wherein the flow director directs the jet substantially in the upwards direction.

14. The fire extinguishing device according to claim 13, wherein the flow director comprises a tubular, flexible nozzle that assumes a shape under presence of the released carbon dioxide to form the jet of the released carbon dioxide.

15. A method for extinguishing a fire comprising providing a fire extinguishing device comprising:

a housing that screws onto a valve opening of a flask that stores compressed carbon dioxide, the flask having a valve that is secured in the valve opening and the valve being spring-loaded towards a closed state, the flask having a longitudinal direction extending in a upwards direction from a bottom of the flask to a top of the flask and a downwards direction from said top to said bottom, a radial direction perpendicular to said longitudinal direction, and an angular direction, and wherein the housing holds the fire extinguishing device in an operating orientation relative to the flask;

an actuator configured to open the valve of the flask in response to force exerted on a lever component of the actuator by a person, opening of the valve resulting in release of the carbon dioxide from the flask via the valve; and a flow director retained by the housing and configured to direct a jet of the released carbon dioxide; and wherein the method further comprises screwing the flask to the housing, and the person directing the flow director towards a base of a fire and applying said force onto the lever.

* * * * *